US011185752B2

(12) United States Patent
Ferrari et al.

(10) Patent No.: US 11,185,752 B2
(45) Date of Patent: Nov. 30, 2021

(54) MULTI-CONFIGURATION BATTING TEE

(71) Applicant: Dick's Sporting Goods, Inc., Coraopolis, PA (US)

(72) Inventors: Lucas Ferrari, Clinton, PA (US); Charles P. Larson, Coraopolis, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 16/864,247

(22) Filed: May 1, 2020

(65) Prior Publication Data

US 2020/0346089 A1 Nov. 5, 2020

Related U.S. Application Data

(60) Provisional application No. 62/841,922, filed on May 2, 2019.

(51) Int. Cl.
*A63B 69/36* (2006.01)
*A63B 69/00* (2006.01)

(52) U.S. Cl.
CPC .. *A63B 69/0075* (2013.01); *A63B 2069/0008* (2013.01); *A63B 2225/093* (2013.01)

(58) Field of Classification Search
CPC ..... A63B 69/0075; A63B 2225/093; A63B 2069/0008; A63B 60/0085; A63B 71/023; A63B 2071/026; A63B 2210/58; A63B 2102/18; A63B 2102/182; A63B 2102/20
USPC ..... 473/417
See application file for complete search history.

(56) References Cited

U.S. PATENT DOCUMENTS

| | | | | | |
|---|---|---|---|---|---|
| 3,139,282 | A | | 6/1964 | Lande | |
| D199,128 | S | | 9/1964 | Madsen | |
| 4,819,937 | A | | 4/1989 | Gordon | |
| 4,938,478 | A | * | 7/1990 | Lay | A63B 69/0091 473/423 |
| 4,962,924 | A | * | 10/1990 | James | A63B 69/0075 473/417 |
| 5,386,987 | A | * | 2/1995 | Rodino, Jr. | A63B 69/0075 473/417 |
| D373,806 | S | | 9/1996 | Bunnell | |
| 5,556,091 | A | | 9/1996 | Lin | |
| 5,967,910 | A | | 10/1999 | Lin | |
| 6,099,418 | A | | 8/2000 | Owen | |
| 6,238,307 | B1 | * | 5/2001 | Owen | A63B 69/0075 473/417 |
| D451,566 | S | | 12/2001 | De Chenne | |

(Continued)

*Primary Examiner* — Nini F Legesse
(74) *Attorney, Agent, or Firm* — Fox Rothschild LLP

(57) ABSTRACT

A base assembly for a batting tee includes a base having a base guide path formed in an upper surface of the base, and a track plate positioned such that the track plate covers at least a portion of the upper surface of the base. The track plate includes a first segment and a second segment that surrounds at least a portion of the first segment. A position of the first segment relative to a position of the second segment defines a track plate guide path that extends between the first segment and the second segment such that the track plate guide path has a same shape as the base guide path and is positioned above the base guide path. Alignment of the track plate guide path and the base guide path form a non-linear track, such that the track is configured to slidably receive a portion of a tee.

36 Claims, 10 Drawing Sheets

(56) References Cited

U.S. PATENT DOCUMENTS

| | | | | |
|---|---|---|---|---|
| 6,413,175 | B1 | 7/2002 | Mooney, Jr. | |
| D513,294 | S | 12/2005 | deGrasse | |
| D534,232 | S | 12/2006 | Rathbun | |
| 7,354,360 | B1 | 4/2008 | Eckstein | |
| 7,648,432 | B1 * | 1/2010 | Hall | A63B 69/0013 473/499 |
| 7,744,496 | B2 * | 6/2010 | Chisena | A63B 69/0075 473/417 |
| D638,079 | S * | 5/2011 | Cheng | D21/717 |
| 8,066,589 | B2 | 11/2011 | Chisena | |
| 9,358,440 | B1 | 6/2016 | Bun-Ell | |
| 2003/0032506 | A1 | 2/2003 | Chi | |
| 2005/0130771 | A1 | 6/2005 | Tsai | |
| 2005/0143196 | A1 * | 6/2005 | Tsai | A63B 69/0002 473/417 |
| 2008/0064534 | A1 | 3/2008 | Lortscher | |
| 2008/0207358 | A1 | 8/2008 | Chisena | |
| 2009/0093325 | A1 | 4/2009 | Meltzer et al. | |
| 2010/0267493 | A1 * | 10/2010 | Chisena | A63B 69/0075 473/417 |
| 2014/0302948 | A1 | 10/2014 | Holland et al. | |
| 2015/0283437 | A1 * | 10/2015 | Liang | A63B 57/10 473/391 |
| 2017/0368436 | A1 | 12/2017 | Bun-Ell | |

* cited by examiner

MULTI-CONFIGURATION BATTING TEE

RELATED APPLICATIONS AND CLAIM OF PRIORITY

This patent document claims priority to U.S. Patent Application No. 62/841,922, filed May 2, 2019, the disclosure of which is fully incorporated into this document by reference.

BACKGROUND

Bat-and-ball games or sports (e.g., baseball or softball), similar to any other sport, requires practice to improve a player's skills. An important aspect of bat-and-ball games or sports is hitting, and many different systems can be used to help a player practice hitting. One common system to aid in improving hitting skills is the use of a batting tee. Batting tees can be used by players of all stages of development (e.g., from little league level up to the professional level).

A common batting tee typically has two portions, a base portion and a tee portion. The base portion is a sturdy base capable of withstanding tipping forces created from batting practice. The base portion may have any shape, such as round, square, or the shape of a home plate of a playing field. The home plate of a playing field is usually defined as having standard dimensions in accordance with the rules of a governing organization such as, for example, Major League Baseball. The base portion may be placed over the home plate on a playing field, replace the home plate of the field, or be placed alone at any location.

The tee portion extends upward from the base portion and has an upper end capable of supporting a ball, such as a baseball, softball, or other batting practice balls. The ball may be balanced on a cup support or may be received in a ball holder portion of the tee portion. The height of the tee portion may be adjustable so as to place the upper ball support end at the desirable height to practice various batting zones.

A batting tee having a fixed tee with no adjustment provides the batter a single practice zone, while a batting tee having a fixed tee with an adjustable tee provides the batter with a single practice zone at various heights. A batting tee having a tee that can be moved to various locations within a track provides a batter with different practice zones along the track length.

SUMMARY

In an embodiment, a base assembly for a batting tee includes a base having a base guide path formed in an upper surface of the base, and a track plate positioned within at least a portion of the base such that the track plate covers at least a portion of the upper surface of the base. The track plate includes a first segment and a second segment. At least a portion of the second segment surrounds at least a portion of the first segment. A position of the first segment relative to a position of the second segment defines a track plate guide path that extends between the first segment and the second segment such that the track plate guide path has a same shape as the base guide path and is positioned above the base guide path. Alignment of the track plate guide path and the base guide path form a non-linear track, such that the track is configured to slidably receive a portion of a tee.

The first segment and the second segment may not be connected. Alternatively, the first segment and the second segment may be connected.

The track plate guide path may have a first width, the base guide path may have a second width, and the first width may be smaller than the second width.

The first segment may have a first edge portion, the second segment may have a second edge portion, the first edge portion may cover a first portion of the base guide path, the second edge portion may cover a second portion of the base guide path, and the first edge portion and the second edge portion may define the track plate guide path.

The track may include one or more portions that run parallel to a longitudinal direction of the base assembly and one or more portions that run divergent to the longitudinal direction of the base assembly.

The base guide path may have a Y-shaped configuration. The track plate guide path may have a Y-shaped configuration. The track may have a Y-shaped configuration.

The tee may include a guide structure, an elongated post, and a tee topper. The elongated post may include a first telescopic segment, a second telescopic segment configured to connect to the first telescopic segment, and an insert configured to be received within an opening of the second telescopic segment. The guide structure may be connected to an end of the insert. The tee topper may be connected to an end of the first telescopic segment.

The guide structure may include a tee car, a guide protrusion, and a threaded connection.

In an embodiment, a batting tee base may include a track formed in an upper surface of the batting tee base. The track may include one or more portions that run parallel to a longitudinal direction of the batting tee base and one or more portions that run divergent to the longitudinal direction of the batting tee base. The track may be configured to slidably receive a portion of a tee. The batting tee base includes a plurality of edges, where each edge is adjacent to at least a portion of the upper surface. The track may have a Y-shaped configuration.

The tee may include a guide structure, and an elongated post connected to the guide structure.

The elongated post may include a first telescopic segment, a second telescopic segment configured to connect to the first telescopic segment, an insert configured to be received within an opening of the second telescopic segment, where the guide structure is connected to an end of the insert, and a tee topper connected to an end of the first telescopic segment.

In an embodiment, a base assembly for a batting tee includes a base having a base guide path formed in an upper surface of the base, and a track plate positioned within at least a portion of the base such that the track plate covers at least a portion of the upper surface of the base. The track plate includes a first segment and a second segment. A position of the first segment relative to a position of the second segment may define a track plate guide path that extends between the first segment and the second segment therein the track plate guide path and the base guide path each has a Y-shape. The track plate guide path may be positioned above the base guide path. Alignment of the track plate guide path and the base guide path may form a non-linear track, such that the track is configured to slidably receive a portion of a tee.

The first segment and the second segment may not be connected. The first segment and the second segment may be connected.

The track plate guide path may have a first width, the base guide path may have a second width, and the first width may be smaller than the second width.

The first segment may have a first edge portion, the second segment may have a second edge portion, the first edge portion may cover a first portion of the base guide path, the second edge portion may cover a second portion of the base guide path, and the first edge portion and the second edge portion may define the track plate guide path.

The track may include one or more portions that run parallel to a longitudinal direction of the base assembly and one or more portions that run divergent to the longitudinal direction of the base assembly.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to."

In this document, when terms such as "first" and "second" are used to modify a noun, such use is simply intended to distinguish one item from another, and is not intended to require a sequential order unless specifically stated.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The present disclosure generally relates to a batting tee. A batting tee may be used to play and/or practice one or more bat-and-ball games or sports such as, for example, baseball, softball, t-ball, cricket, and/or the like. References to various embodiments and examples set forth in this specification do not limit the scope of this disclosure and merely set forth some of the many possible embodiments of the appended claims.

Figure 1:
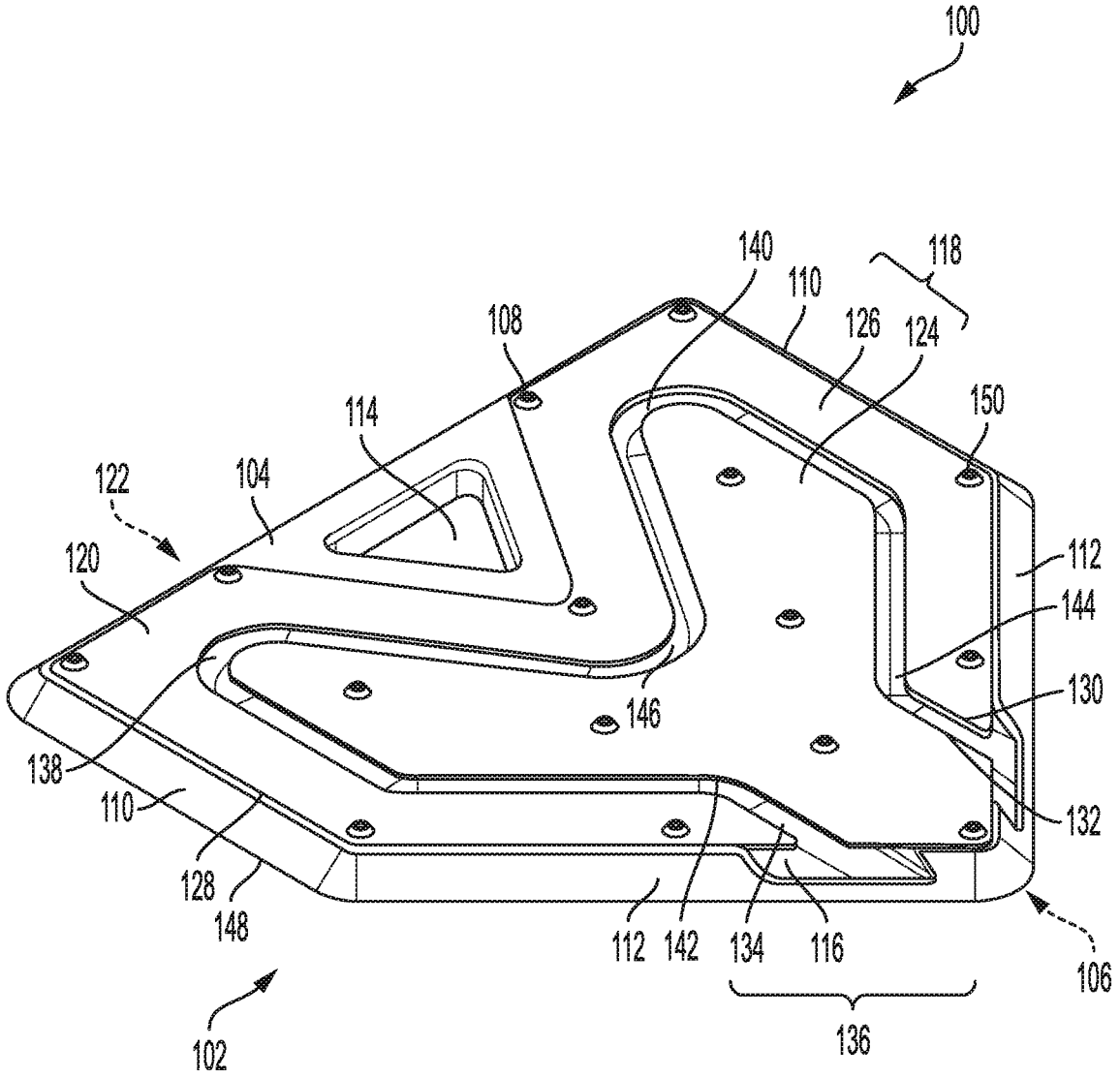
FIG. 1 illustrates an example multi-configuration batting tee base assembly.

A multi-configuration batting tee may include a base assembly and a guided tee assembly. FIG. 1 illustrates an example base assembly 100 for a multi-configuration batting tee according to various embodiments. As shown in FIG. 1, the base assembly 100 may include a base 102 and a track plate 118.

The base 102 may have various shapes, such as, for example, round, square, or pentagon. A base 102 having a pentagon shape may have dimensions to match a home plate's dimensions. The base 102 may be pentagonally shaped with two right angles and a V-shaped portion. The base 102 may be sized to be placed on top of a home plate on a playing field or to replace the home plate. The base 102 may also be placed at any other location.

The base 102 may have an upper surface 104, a lower surface 106, a front edge 108, two side edges 110, and two baseline edges 112. The baseline edges 112, when placed on a playing field may align with one or more of the baselines of the field. The front edge 108 of the base 102 may face a pitching mound. The base 102 may be symmetrical to provide even batting practice opportunities for both left-handed and right-handed batters. The base may optionally include a handle 114 formed as an aperture for transporting the base assembly 100. As illustrated in FIG. 1, an example handle 114 may be formed as a triangular shaped aperture adjacent the front edge 108. Alternatively shaped handles may be used within the scope of this disclosure.

The base 102 may be a sturdy platform from which a batting practice tee assembly may extend upward, as will be describe in more detail below. The base 102 may be fabricated from a material such as rubber, plastic, metal, or the like, or a combination thereof. The base 102 may have a weight appropriate to withstand tipping due to batting forces striking a ball from an attached guided tee assembly, as will be described in more detail below.

The base 102 may have at least one guide path 116 formed in the upper surface 104 of the base 102. The base guide path 116 may be a recessed groove. The groove of the base guide path 116 may have various dimensions. In various embodiments, the groove may have a consistent cross-section. For example, the base guide path 116 may have a consistent U-shaped cross-section. In other embodiments, the base guide path 116 may have a cross-section having an inconsistent cross-section. The base guide path 116 may be a linear groove or a non-linear groove. For example, FIG. 1 illustrates an example of a non-linear groove forming a Y-shaped base guide path 116.

Figure 2A:
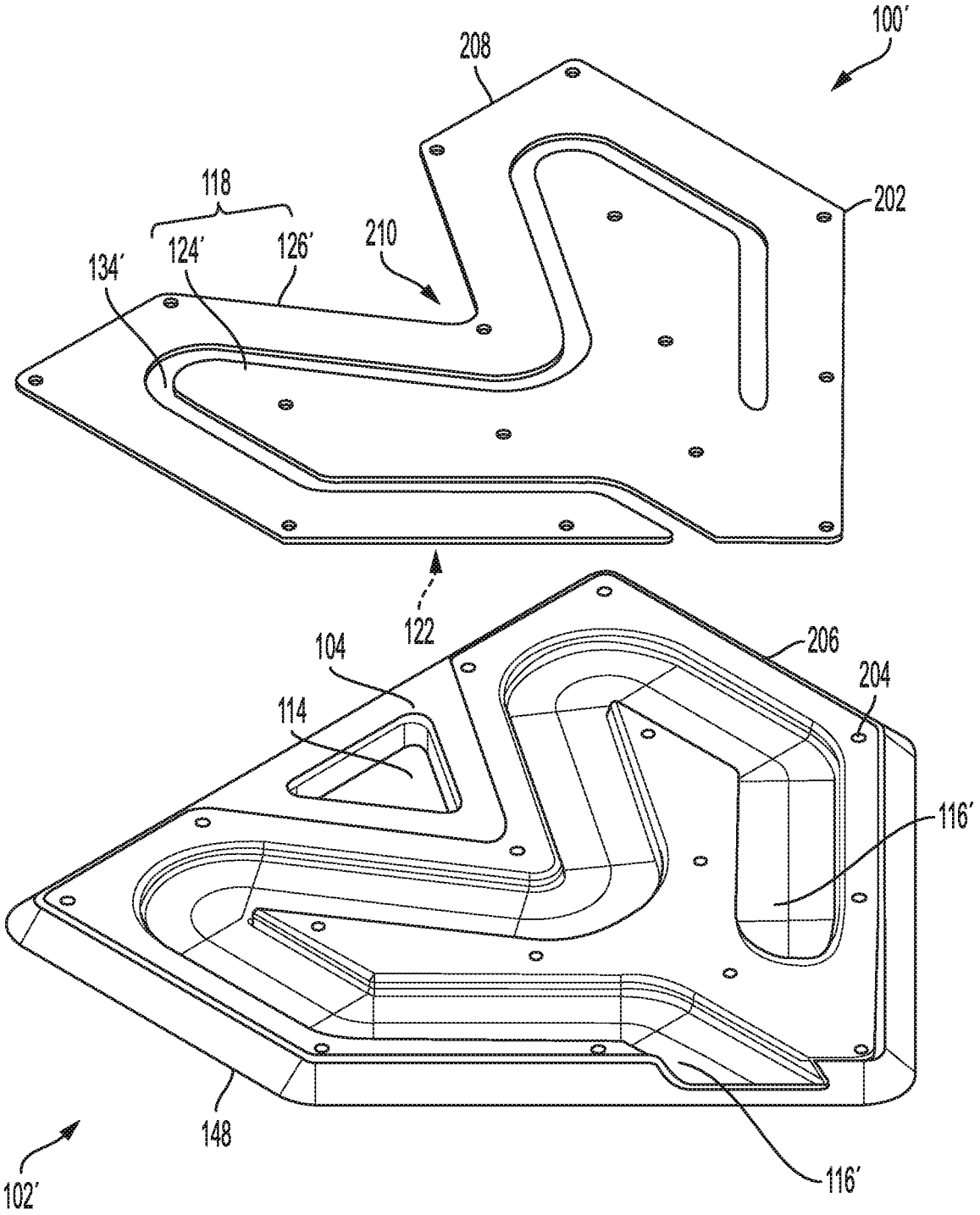
FIGS. 2A-2C illustrate expanded views of various example base assemblies.

The track plate 118 may have a single planar sheet or it may be formed by at least two planar sheets. For example, FIG. 2A illustrates an example track plate 118' formed by a single planar sheet. Track plate 118' may have a first segment 124' and a second segment 126'. Likewise, FIG. 2B illustrates another example track plate 118 formed by at least two planar sheets 124, 126, as will be described in more detail below.

The track plate 118 may be formed by a planar sheet of material having an upper surface 120 and a lower surface 122. The track plate 118 may be fabricated from a material such as plastic, metal, or the like, or a combination thereof. The track plate 118 may have a strength appropriate to withstand fracture due to batting forces striking a ball from an attached guided tee assembly, as will be described in more detail below.

As seen in FIG. 2A, an alternate base assembly 100' may be formed by a base 102' and a track plate 118'. The boundary between the first segment 124' and the second segment 126' of the track plate 118' may have a width so as to form a closed guide path 134' of the track plate 118'. In various embodiments, this width may be constant. Likewise, the guide path 116' of the base 102' may also have a width so as to form a closed base guide path 116'. In various embodiments, this width may be constant. The track plate guide path 134' may be directly above and congruent with the base guide path 116'. Alignment of the track plate guide path 134' and base guide path 116' may form a closed track. The closed track may be sized to slidably receive a guide structure of a guided tee assembly, as will be described in more detail below.

Figure 2B:
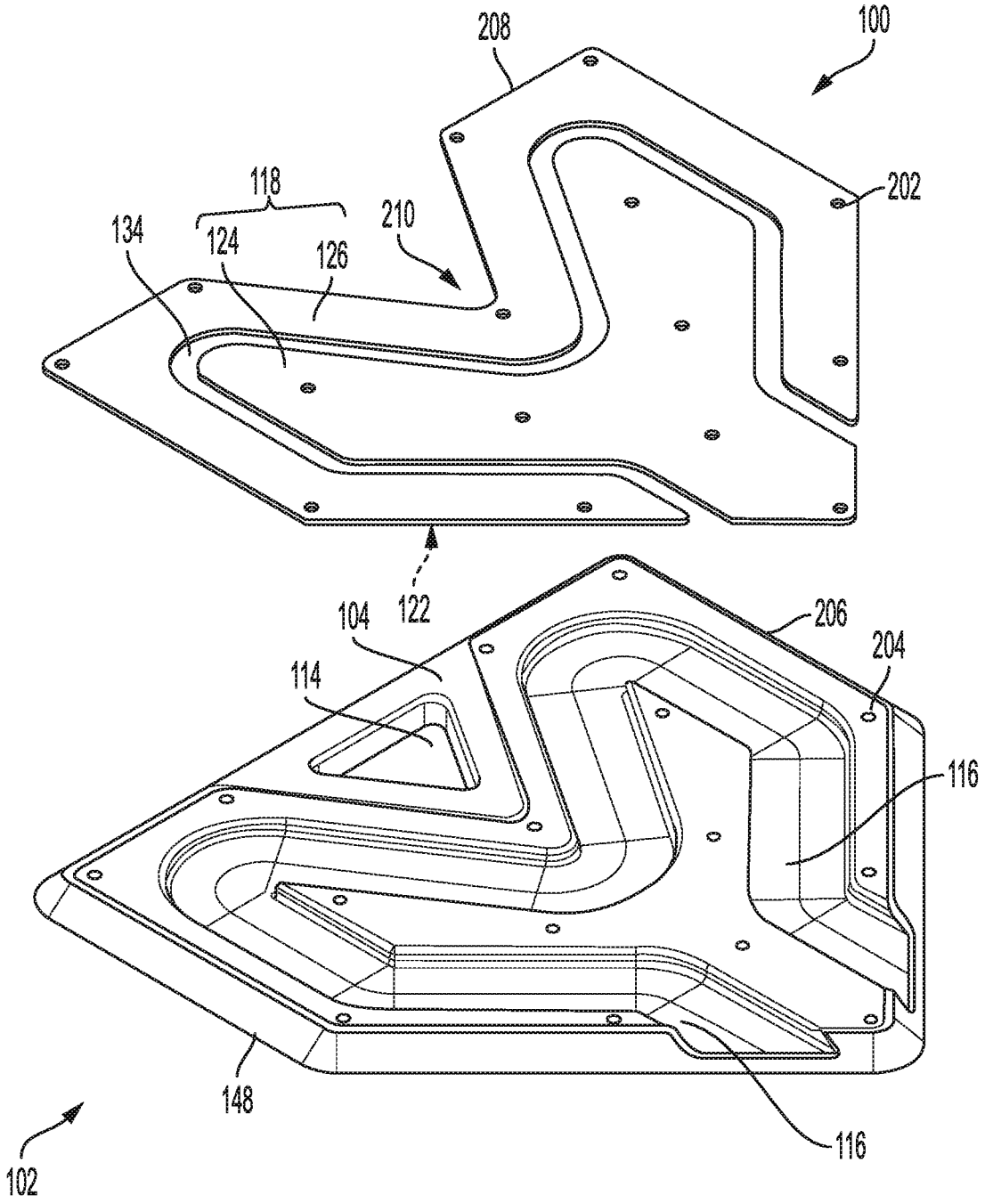

As seen in FIG. 2B, the track plate 118 may be formed by a first segment, such as an outer plate 126 and a second segment, such as an in inner plate 124 placed substantially within the perimeter 128 of the outer plate 126. The inner plate 124 may have various shapes. For example, FIG. 1 illustrates an inner plate 124 having a Y-shape. However, alternate shapes may be used within the scope of this disclosure. The inner edge 130 of the outer plate 126 may also have various sizes that correspond to the outer edge 132 of the inner plate 124. For example, FIG. 1 illustrates an outer plate 126 having an inner edge 130 corresponding to the Y-shaped outer edge 132 of the inner plate 124.

The boundary between the inner plate 124 and the outer plate 126 may have a constant width so as to form a guide path 134 of the track plate 118. The track plate guide path 134 may be positioned above the base guide path 116 so the two guide paths are aligned. Alignment of the track plate guide path 134 and the base guide path 116 may form a track 136. The track 136 may be sized to slidably receive a guide structure of a guided tee assembly, as will be described in more detail below.

FIG. 1 illustrates a Y-shaped track 136 having multiple nodes 138, 140, 142, 144, 146. A node may be a point on the track 136 where two linear segments of the track intersect. A guided tee assembly may be placed at a number of different positions along the track 136, but may be especially placed at one or more of the nodes 138, 140, 142, 144, 146. The design and placement of the nodes 138, 140, 142, 144, 146 on the track plate 118 allows for both left-handed and right-handed batters to practice hitting balls that are more to the inside of the strike zone (e.g., nodes 138, 140), more to the outside of the strike zone (e.g., nodes 142, 144), and to the center of the strike zone (e.g., node 146). For example, a right-handed batter standing to the left of the base assembly 100 may swing at a ball placed atop a guided tee assembly located at nodes 138, 146, or 144 to practice hitting balls thrown in the inside of the strike zone, center of the strike zone, and outside of the strike zone, respectively. As another example, a left-handed batter standing to the right of the base assembly 100 may swing at a ball placed atop a guided tee assembly located at nodes 140, 146, or 142 to practice hitting balls thrown in the inside of the strike zone, center of the strike zone, and outside of the strike zone, respectively. It is understood that fewer or additional nodes may be used within the scope of this disclosure. Alternative placement of one or more nodes may be used within the scope of this disclosure.

Node placements may be above and within the perimeter 148 of the base assembly 100. To practice hitting a ball from a batting tee in a strike zone, one or more nodes may be located within the perimeter 148 of the batting tee (e.g., directly over the notional home plate) so as to replicate a hitting zone within the common strike zone. For example, placing the nodes forward of the front edge 108 of the base 102 would not replicate a hitting zone within the common strike zone.

Figure 2C:
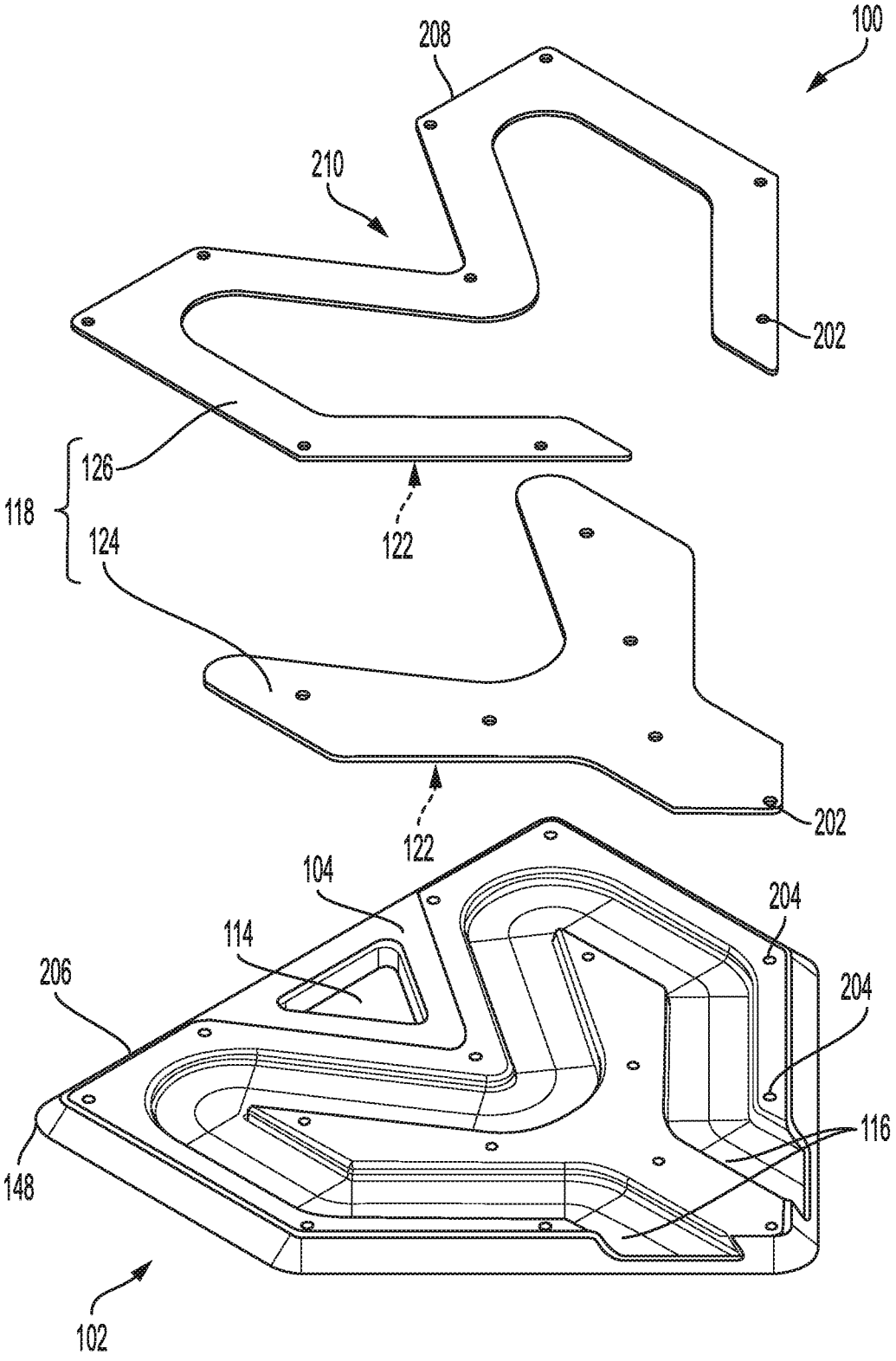

FIG. 2B and FIG. 2C illustrate expanded views of the example base assembly 100 of FIG. 1 according to various embodiments. The track plate 118 may have a shape to match a shape of the base 102. As seen in FIG. 2B, the track plate guide path 134 is the space between the inner plate 124 and outer plate 126. As seen in FIG. 2C, the track plate 118 may include two separate plates, such as a Y-shaped inner plate 124 and an outer plate 126 having a Y-shaped opening. The track plate 118 may be attached directly to the upper surface 104 of the base 102 to form the base assembly 100. Various attachment mechanisms 150, such as, for example, adhesives, clips, screws, and/or the like may be used. For example, FIG. 1 illustrates at least one screw that may be used to connect the track plate 118 to the base 102. An attachment mechanism 150 may be threaded into the material of the base 102, or it may pass through an aperture 202 of the track plate 118, through a corresponding aperture 204 of the base, and then fastened (for example, by using a nut) on the lower surface 106 of the base 102.

The track plate 118 may be sized to cover the base 102. Alternatively, it may have a reduced size so as to fit recessed within a raised edge 206 along the perimeter 148 of the base assembly 100. If a handle 114 is present on the base 102, the front edge 208 of the track plate 118 may have a notch 210 so as to fit recessed adjacent the handle of the base. The height of the raised perimeter edge 206 of the base 102 may be sized to allow the track plate 118 to be attached flush with the upper surface of the raised perimeter edge.

The base assembly 100 may be formed by multiple plates, e.g., 102, 124, and 126. The plates may be joined to form a track 136. The track 136 may have various shapes, such as a Y-shaped configuration. In various embodiments, the track 136 may be a continuous track. In other embodiments, the track may not be continuous. For example, the track may have one or more segments that are not connected in a continuous manner.

In various embodiments, the base guide path 116, the track plate guide path 134, and/or the track 136 may have a constant width. In other embodiments, one or more of the base guide path 116, the track plate guide path 134, and/or the track 136 may not have constant width.

The base 102 may be a first plate having the base guide path 116, which may be an indention. The base guide path 116 may have various shapes, such as, for example, a Y-shaped configuration. The first plate 102 may be sized to be larger than both a second plate 124 and a third plate 126. The inner plate 124 may be a second plate 124. The second plate 124 may have various shapes, such as, for example, a Y-shape. The second plate 124 may be sized to cover an inner portion of the base guide path 116 of the first plate 102. The second plate 124 may be attachable to the first plate by one or more attachment mechanisms 150. The outer plate 126 may be a third plate. The third plate may have various shapes, such as, for example, having a Y-shaped opening. The third plate 126 may be sized to surround the outer edge 132 of the second plate 124. The third plate 126 may cover an outer portion of the base guide path 116 of the first plate 102. The third plate 126 may be attachable to the first plate 124 by one or more attachment mechanisms 150. Covering the inner portion and the outer portion of the base guide path 116 of the first plate 102 may form the track plate guide path 134, which may be a Y-shaped gap between the second and third plates 124, 126. The Y-shaped gap (i.e., the track plate guide path 134) and the Y-shaped indention (i.e., the base guide path 116) of the first plate 102 may form a Y-shaped track 136.

Figure 3:
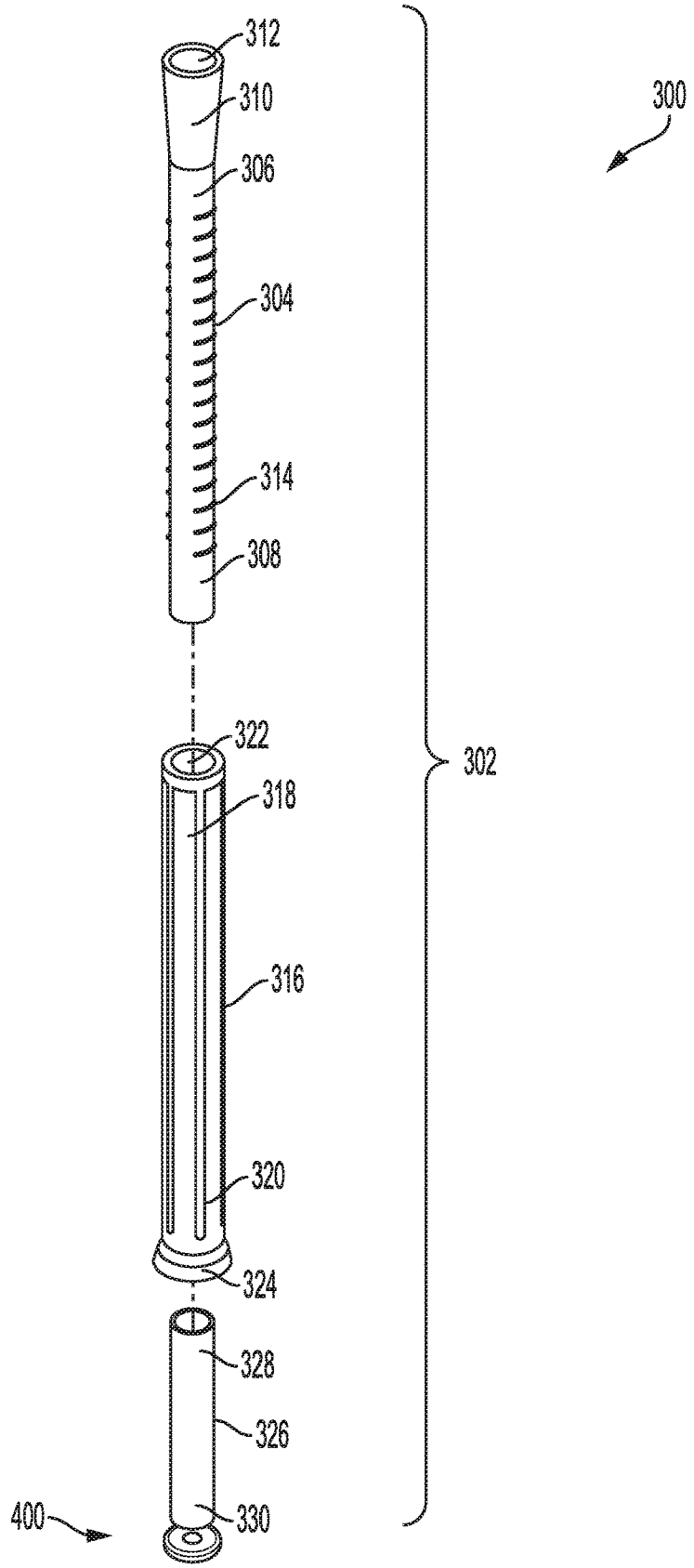
FIG. 3 illustrates an expanded view of an example guided tee assembly.

FIG. 3 illustrates an example guided tee assembly 300 according to various embodiments. A guided tee assembly 300 may have an elongated post 302 with a guide structure 400 located at the lower end of the assembly. The elongated post 302 may be an integral post or may be segmented to provide a height adjustment. For example, as shown in FIG. 3, the guided tee assembly 300 may include a first telescopic segment 304, a second telescopic segment 316, a reinforcement insert 326, and the guide structure 400.

The first telescopic segment 304 may have an upper end 306 and a lower end 308. The upper end 306 of the first telescopic segment 304 may have a tee topper 310 configured to support a ball, such as a baseball, softball, or other batting practice balls. As illustrated in FIG. 3, a tee topper 310 may have a generally cone shape. A ball may be balanced on a cup support or it may be received in a ball holder portion 312 of the tee topper 310. The lower end 308 of the first telescopic segment 304 may have a height-adjustment feature 314, such as, for example, a plurality of spaced ribs. The height of the guided tee assembly 300 may be adjustable so the ball holder portion 312 may be placed at a desirable height. For example, a ball holder portion 312 may be positioned at various heights to accommodate players of different heights, or to allow players to practice various batting zones.

The second telescopic segment 316 may have an upper end 318 and a lower end 320. The upper end 318 of the second telescopic segment 316 may have a matching height-adjustment feature 322 that cooperates with the height-adjustment feature 314 on the lower end 308 of the first telescopic segment 304 to provide an adjustable height of the guided tee assembly 300. The lower end 320 of the second telescopic segment 316 may have an enlarged bottom 324 to provide a sturdy support near the connection point of the guided tee assembly 300 to the base assembly 100. The enlarged bottom 324 of the second telescopic segment 316 may have an opening capable to receive the reinforcement insert 326.

In various embodiments, the height-adjustment feature 314 of the first telescopic segment 304 may be one or more notches. The height-adjustment feature 322 of the second telescopic segment 316 may be an opening and a notch insert, such that the opening may be sized to accommodate at least a portion of the first telescopic segment 304. One or more of the notches 314 may be sized to fit within the notch insert and configured to be inserted and removed from the notch to adjust the height of the guided tee assembly 300.

A reinforcement insert 326 may have an upper end 328 and a lower end 330. The upper end 328 of the reinforcement insert 326 may be sized to fit in the opening of the enlarged bottom 324 of the second telescopic segment 316. The reinforcement insert 326 may help reinforce or provide support to the elongated post 302. The first and second telescopic segments 304, 316 may be fabricated from a lightweight material, such as plastic, rubber, or the like. The reinforcement insert 326 may be fabricated from a heavier material, such as rigid plastic, metal, or the like. The lightweight material of the telescopic segments 304, 316 may allow for a resistance to deformation when struck by an errant bat swing hitting the guided tee assembly 300 instead of the ball. The stronger reinforcement insert 326 may provide a sturdy support for the telescopic segments 304, 316 without deforming the base assembly 100 during, for example, an errant bat swing. The lower end 330 of the reinforcement insert 326 may have a threaded connection. The threaded connection may be a threaded stud extending from the lower end 330 of the reinforcement insert 326 or it may be a threaded opening into the lower end 330 of the reinforcement insert 326. Various other types of connections may be used within the scope of this disclosure.

Figure 4:
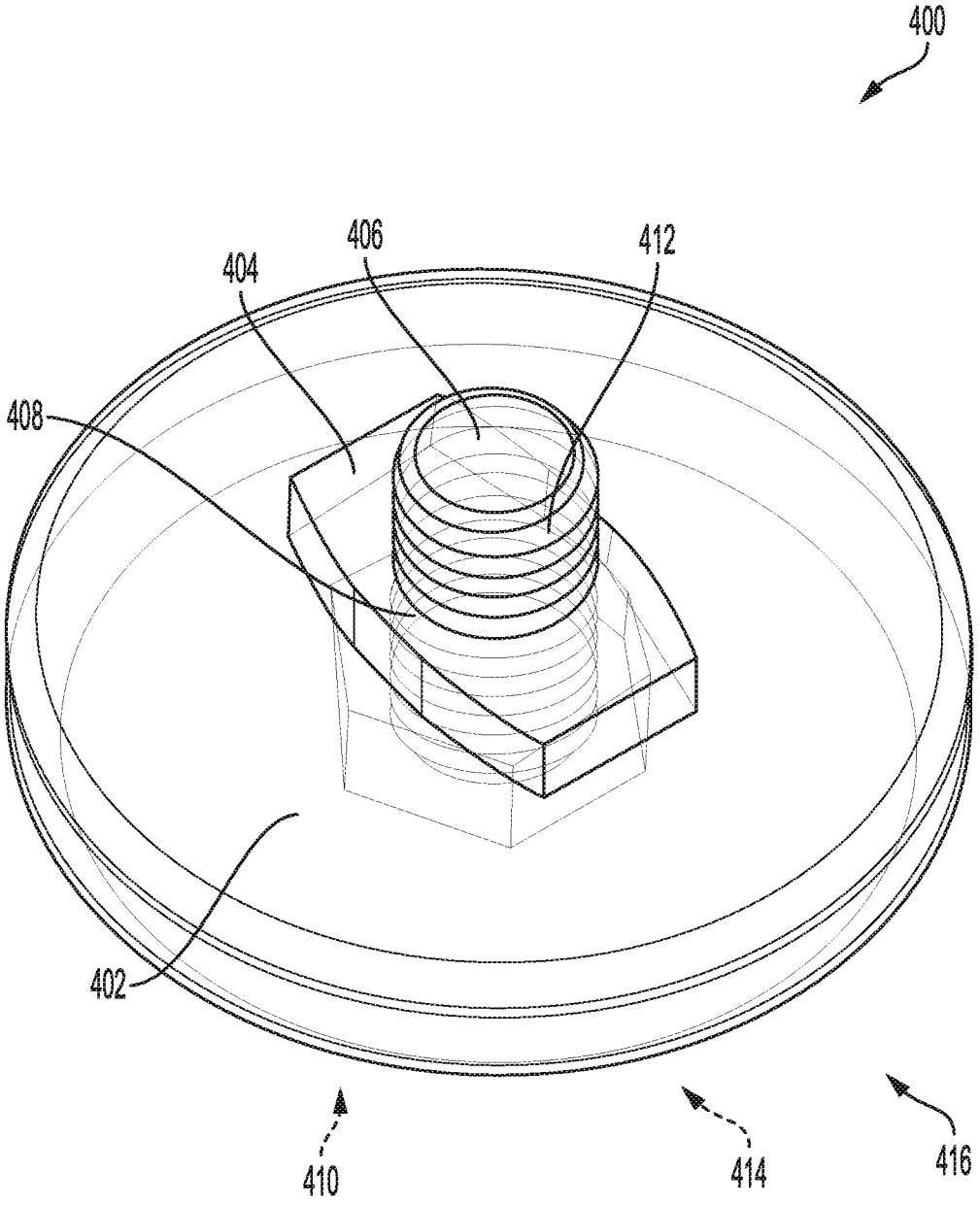
FIG. 4 illustrates an example guide structure.

FIG. 4 illustrates an example guide structure 400 for a guided tee assembly 300 according to various embodiments. As shown in FIG. 4, the guide structure 400 may include a tee car 402, a guide protrusion 404, and a threaded connection 406. The guide structure 400 may be sized to be received by and move along the track 136 of the base assembly 100.

The tee car 402 may be sized to move along the base guide path 116. The tee car 402 may be configured and sized to navigate a base guide path 116 that is non-linear with curves. The tee car 402 may be round and have a height capable of fitting within the base guide path 116. However, it is understood that the tee car 402 may have various other shapes. The tee car 402 may be fabricated from a material capable of withstanding fracture due to batting forces. For example, the tee car 402 may be fabricated from metal, plastic, and/or the like, or a combination thereof.

The guide protrusion 404 may be sized to move along the track plate guide path 134. For example, the guide protrusion 404 may be sized to navigate a track plate guide path 134 that is non-linear with curves. The guide protrusion 404 may be have a faceted shape such as a square, rectangle, block or the like. For example, as seen in FIG. 4, the guide protrusion 404 may have a blunted oval faceted shape. The guide protrusion 404 may have a length capable of resisting rotation so as to limit the guide structure 400 from rotating within the track plate guide path 134, as will be described below. The guide protrusion 404 may have a height dimension smaller than the thickness of the track plate 118 so as to allow the track plate 118 to be compressed between the enlarged bottom 324 of the second telescopic segment 316 and the tee car 402, as will be described below. The guide protrusion 404 may be fabricated from a material capable of withstanding fracture due to batting forces. For example, the guide protrusion 404 may be fabricated from metal, plastic, or the like, or a combination thereof.

The threaded connection 406 may have an opening 408 into the guide protrusion 404 and/or tee car 402. Alternately, the threaded connection 406 may be a threaded stud that extends upward from the guide protrusion 404. The opening 408 may be a threaded opening capable of receiving a threaded stud extending from the reinforcement insert 326. The opening 408 may allow for a threaded stud to extend from the reinforcement insert 326 to be captured (e.g., within a nut fastener) on the bottom 410 of the tee car 402. The threaded connection 406 may extend upward from the guide protrusion 404. For example, the threaded connection may be the threaded portion 412 of a bolt 414 extending upward through the aperture 408 of the tee car 402 and guide protrusion 404. The threaded connection 406 may also be a threaded stud integrally formed from the guide protrusion 404. The threaded connection 406 of the guide structure 400 may cooperate with the threaded connection of the reinforcement insert 326 forming a combined attachment structure. The tee car 402, guide protrusion 404, and threaded connection 406 may be integrally connected or they may be separate parts. As shown in FIG. 4, the threaded connection 406 may be a bolt 414 passing through an opening 408 formed in an integral tee car 402 and guide protrusion 404 combination 416.

Figure 5:
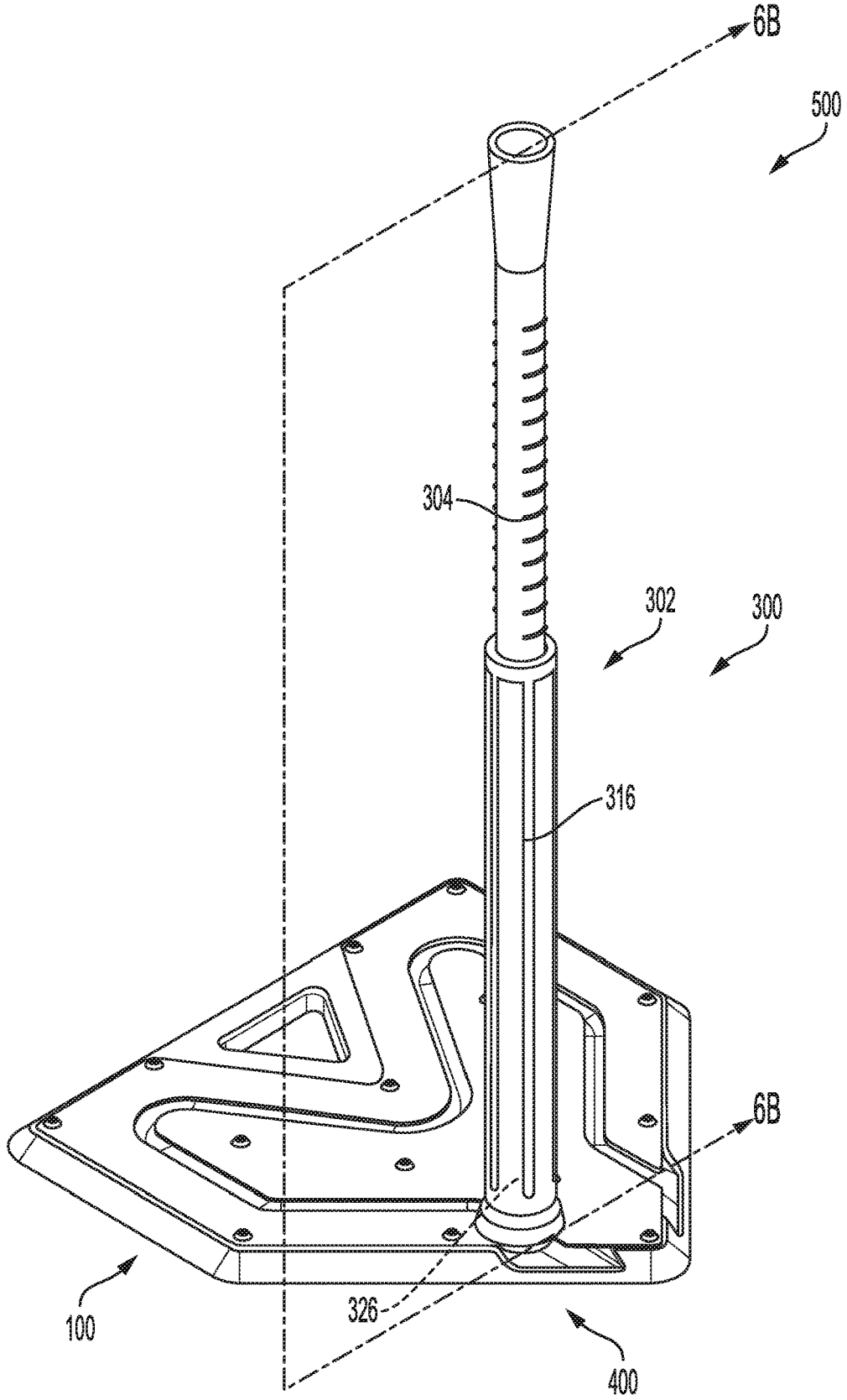
FIG. 5 illustrates an example multi-configuration batting tee base assembly and guided tee assembly.

FIG. 5 illustrates an example multi-configuration batting tee 500 according to various embodiments. As illustrated in FIG. 5, the first and second telescopic segments 304, 316 may be connected together. The reinforcement insert 326 may be fixed into the opening in the bottom end 320 of the second telescopic segment 316. The guide structure 400 may be connected to the reinforcement insert 326 of the elongated post 302 to form the guided tee assembly 300. The guide structure 400 of the guided tee assembly 300 may be inserted in to the track 136 of the base assembly 100. The tee car 402 may slide within the base guide path 116 while the guide protrusion 404 may slide within the track plate guide path 134. Once the desired location of the guided tee assembly 300 is reached, the second telescopic segment 316 may be rotated, thus rotating the fixed reinforcement insert 326 and associated threaded connection. This rotation may draw the guide structure 400 closer to the enlarged bottom 324 of the second telescopic segment 316 thus compressing the inner and outer plates 124, 126 of the track plate 118. The guided tee assembly 300 may be secured to the base assembly 100 forming a multi-configuration batting tee 500 as seen in FIG. 5.

Figure 6A:
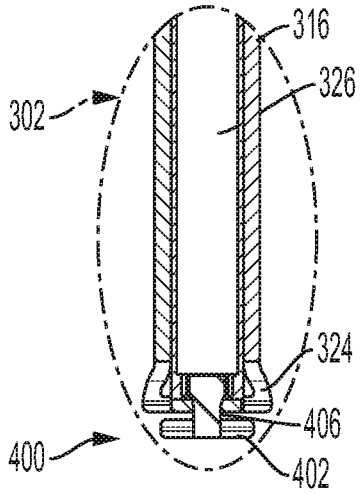
FIG. 6A illustrates a sectional view of a lower end of an example guided tee assembly.
Figure 6B:
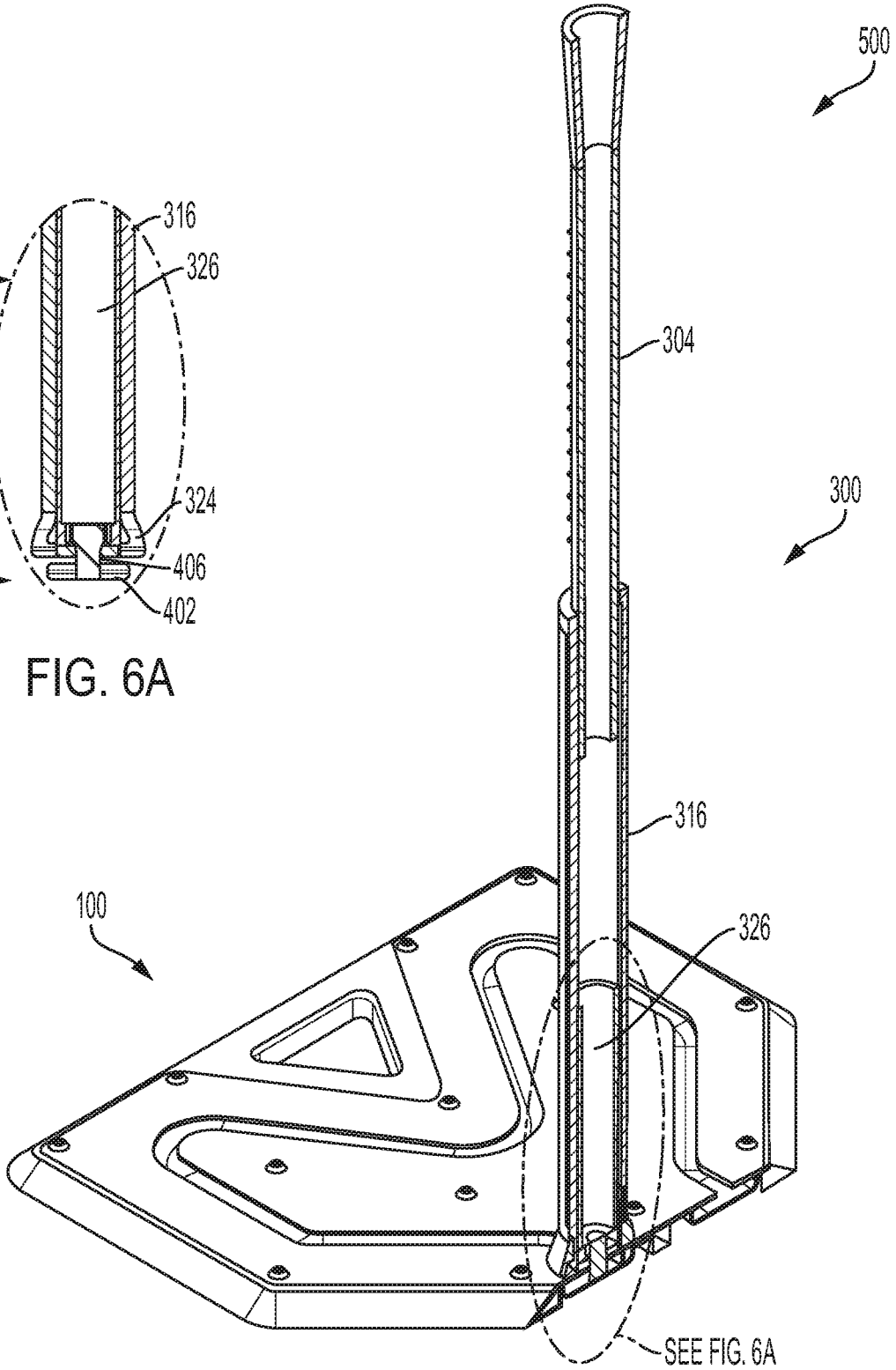
FIG. 6B illustrates a sectional view of an example multi-configuration batting tee base assembly and guided tee assembly.

FIG. 6B is a sectional view along cut-plane 6B-6B of the multi-configuration batting tee of FIG. 5 illustrating an example compressed connection according to various embodiments. This compressed connection may provide resistance to deformation of the track plate 118 and tipping of the base 102 during batting practice. FIG. 6A is a sectional view along a portion of the multi-configuration batting tee 500 of FIG. 6B illustrating the threaded connection 406, reinforcement insert 326, and enlarged bottom 324 of the second telescopic segment 316 according to various embodiments. The first telescopic segment 304 may also be adjusted with respect to the second telescopic segment 316 to set the height of the tee topper 310 at the desired batting practice zone.

Figure 7:
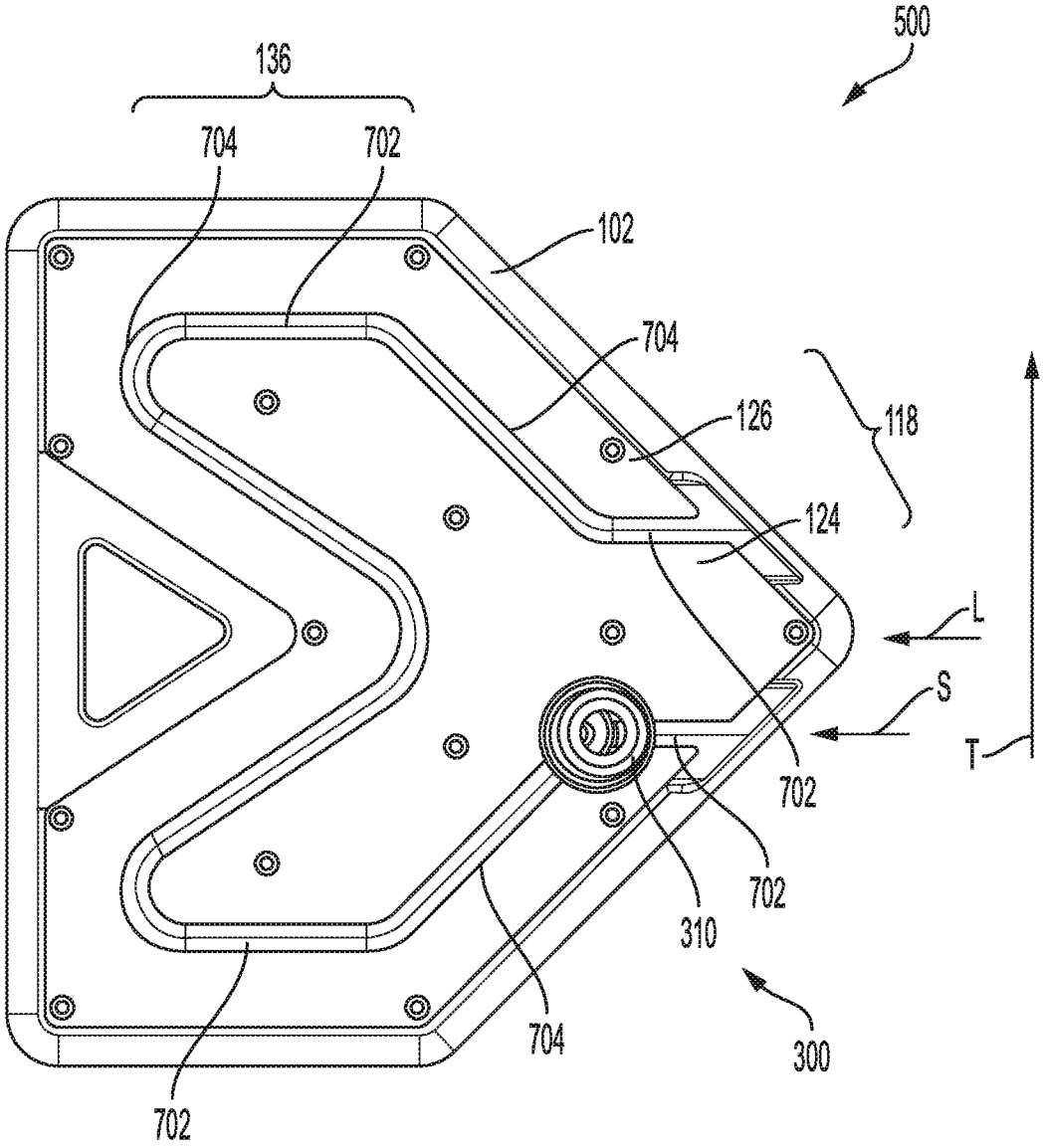
FIG. 7 illustrates an example multi-configuration batting tee base assembly and guided tee assembly.

FIG. 7 illustrates a top view of an example multi-configuration batting tee 500 according to various embodiments. The multi-configuration batting tee 500 may have a longitudinal direction L and a tangential direction T, which is perpendicular to the longitudinal direction L. The track 136 may include one or more portions that are parallel 702 to the longitudinal direction L and one or more portions 704 that are divergent to the longitudinal direction L. A batter may swing a bat along a swing direction S to practice hitting a ball on the tee topper 310 atop the guided tee assembly 300. The swing direction S may be generally parallel to the longitudinal direction L of the multi-configuration batting tee 500. A bat hitting a ball in the swing direction S may provide a striking force substantially in the longitudinal direction L with negligible force in the tangential direction T. For example, the striking force may have a longitudinal component along the longitudinal direction L and a tangential component along the tangential direction T wherein the longitudinal force component is substantially larger than the tangential force component.

When the guided tee assembly 300 is located at a point along the track portion 702 parallel to the longitudinal direction L, the longitudinal force component of the striking force may cause the guided tee assembly 300 to slide forward in the longitudinal direction. However, when the guided tee assembly 300 is located at a point along the track portion 704 divergent to the longitudinal direction L, the longitudinal force component of the striking force may not cause the guided tee assembly 300 to slide forward in the longitudinal direction because edges of the track portion 704 may restrict the forward movement of the guide protrusion 404 of the guide structure 400. This ensures the tee assembly 300 located at a point along the track portion 704 divergent to the longitudinal direction L to remain in the initial placement during batting practice.

Figure 8:
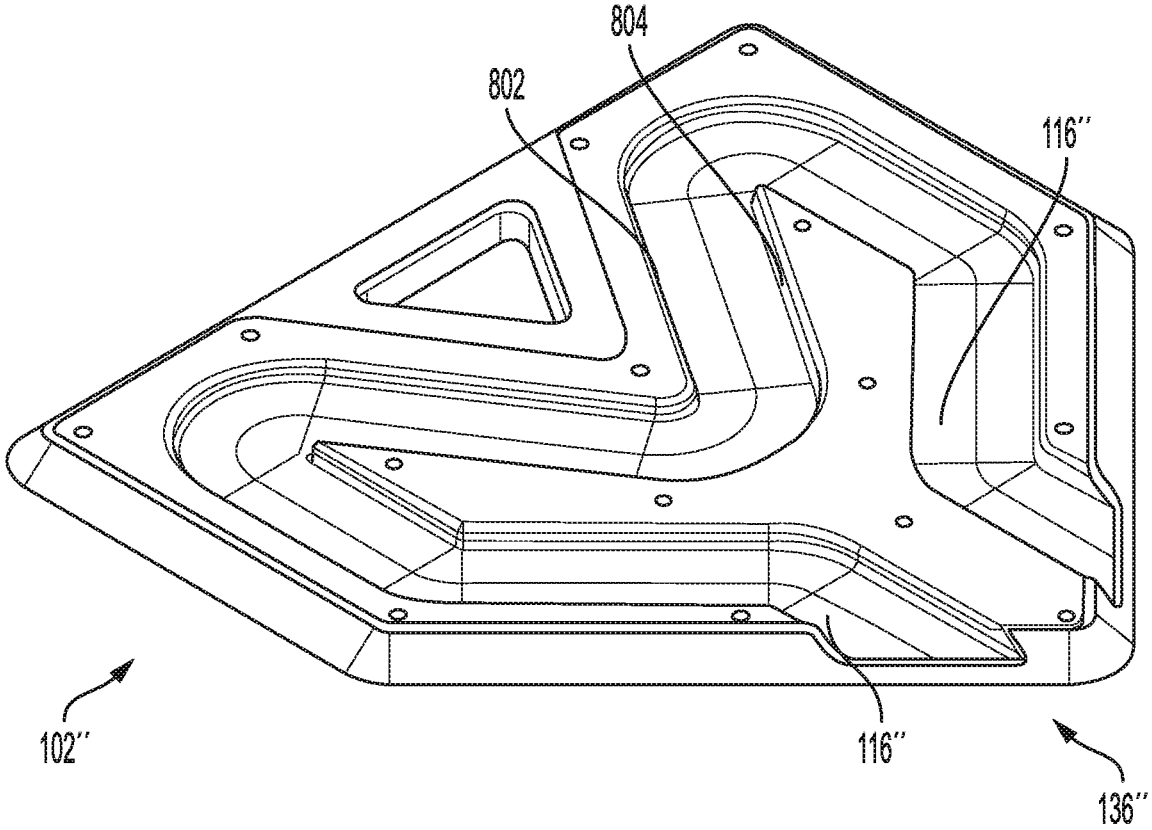
FIG. 8 illustrates an example multi-configuration batting tee base.

FIG. 8 illustrates an example multi-configuration batting tee base 102" according to various embodiments. The base 102" may be used without a track plate 118 as a stand-alone base. The base guide path 116" of the stand-alone base 102" forms a complete track 136", such as, for example, the Y-shaped track illustrated in FIG. 8. The groove of the track 136" may have various dimensions or may have a consistent cross-section. For example, the track 136" may have a consistent U-shaped cross-section having inwardly slanted sidewalls 802, 804. Outer sidewall 802 and inner sidewall 804, while not identical, may have matching cross-sectional shapes. For example, the inwardly slanted sidewalls 802, 804 may form an open trapezoidal shape that allows a guided tee assembly 300 to slide along the track 136" to a node and then lock in place against the sidewalls 802, 804. A tee car of the guided tee assembly 300 similar to the tee car 402 may have a matching trapezoidal shape for use with slanted sidewalls 802, 804 or may have an expanding feature for use with normal sidewalls to lock the guided tee assembly in the desired location. The track 136" may be a linear groove or a non-linear groove. For example, FIG. 8 illustrates an example of a non-linear groove forming a Y-shaped track 136". In various embodiments, the track 136" may have an inconsistent cross-section.

The features and functions described above, as well as alternatives, may be combined into many other different systems or applications. Various alternatives, modifications, variations or improvements may be made by those skilled in the art, each of which is also intended to be encompassed by the disclosed embodiments.

What is claimed is:

1. A base assembly for a batting tee, the base assembly comprising:

a base having a base guide path formed in an upper surface of the base; and a track plate positioned within at least a portion of the base such that the track plate covers at least a portion of the upper surface of the base, wherein:

the track plate comprises a first segment and a second segment, at least a portion of the second segment surrounds at least a portion of the first segment, a position of the first segment relative to a position of the second segment defines a track plate guide path that extends between the first segment and the second segment such that the track plate guide path has a same shape as the base guide path and is positioned above the base guide path, the track plate guide path has a first width, the base guide path has a second width, the first width is smaller than the second width, and alignment of the track plate guide path and the base guide path form a non-linear track, such that the track is configured to slidably receive a portion of a tee.

2. The base assembly of claim 1, wherein the first segment and the second segment are not connected.

3. The base assembly of claim 1, wherein the first segment and the second segment are connected.

4. The base assembly of claim 1, wherein:

the first segment has a first edge portion, the second segment has a second edge portion, the first edge portion covers a first portion of the base guide path, the second edge portion covers a second portion of the base guide path, and the first edge portion and the second edge portion define the track plate guide path.

5. The base assembly of claim 1, wherein the track includes one or more portions that run parallel to a longitudinal direction of the base assembly and one or more portions that run divergent to the longitudinal direction of the base assembly.

6. The base assembly of claim 1, wherein the base guide path has a Y-shaped configuration.

7. The base assembly of claim 1, wherein the track plate guide path has a Y-shaped configuration.

8. The base assembly of claim 1, wherein the track has a Y-shaped configuration.

9. The base assembly of claim 1, wherein the tee comprises:

a guide structure;

an elongated post comprising:

a first telescopic segment, a second telescopic segment configured to connect to the first telescopic segment, and an insert configured to be received within an opening of the second telescopic segment, wherein the guide structure is connected to an end of the insert; and a tee topper connected to an end of the first telescopic segment.

10. The base assembly of claim 9, wherein the guide structure comprises:

a tee car;

a guide protrusion; and a threaded connection.

11. The base assembly of claim 1, wherein:

the first segment has a first edge portion, the second segment has a second edge portion, the first edge portion covers a first portion of the base guide path, the second edge portion covers a second portion of the base guide path, the first edge portion and the second edge portion define the track plate guide path.

12. A batting tee base, comprising:

a track formed in an upper surface of the batting tee base, wherein:

the track includes one or more portions that run parallel to a longitudinal direction of the batting tee base and one or more portions that run divergent to the longitudinal direction of the batting tee base, the track is configured to slidably receive a portion of a tee; and a plurality of edges, wherein each edge is adjacent to at least a portion of the upper surface.

13. The batting tee base of claim 12, wherein the track has a Y-shaped configuration.

14. The batting tee base of claim 12, wherein the tee comprises:

a guide structure; and an elongated post connected to the guide structure.

15. The batting tee base of claim 14, wherein the elongated post comprises:

a first telescopic segment;

a second telescopic segment configured to connect to the first telescopic segment; and an insert configured to be received within an opening of the second telescopic segment, wherein the guide structure is connected to an end of the insert; and a tee topper connected to an end of the first telescopic segment.

16. A base assembly for a batting tee, the base assembly comprising:

a base having a base guide path formed in an upper surface of the base; and a track plate positioned within at least a portion of the base such that the track plate covers at least a portion of the upper surface of the base, wherein:

the track plate comprises a first segment and a second segment, a position of the first segment relative to a position of the second segment defines a track plate guide path that extends between the first segment and the second segment wherein the track plate guide path and the base guide path each has a Y-shape, the track plate guide path has a first width, the base guide path has a second width, the first width is smaller than the second width, the track plate guide path is positioned above the base guide path, and alignment of the track plate guide path and the base guide path form a non-linear track, such that the track is configured to slidably receive a portion of a tee.

17. The base assembly of claim 16, wherein the first segment and the second segment are not connected.

18. The base assembly of claim 16, wherein the first segment and the second segment are connected.

19. The base assembly of claim 16, wherein the track includes one or more portions that run parallel to a longitudinal direction of the base assembly and one or more portions that run divergent to the longitudinal direction of the base assembly.

20. A base assembly for a batting tee, the base assembly comprising:

a base having a base guide path formed in an upper surface of the base; and a track plate positioned within at least a portion of the base such that the track plate covers at least a portion of the upper surface of the base, wherein:

the track plate comprises a first segment and a second segment, at least a portion of the second segment surrounds at least a portion of the first segment, a position of the first segment relative to a position of the second segment defines a track plate guide path that extends between the first segment and the second segment such that the track plate guide path has a same shape as the base guide path and is positioned above the base guide path, the first segment has a first edge portion, the second segment has a second edge portion, the first edge portion covers a first portion of the base guide path, the second edge portion covers a second portion of the base guide path, the first edge portion and the second edge portion define the track plate guide path, and alignment of the track plate guide path and the base guide path form a non-linear track, such that the track is configured to slidably receive a portion of a tee.

21. The base assembly of claim 20, wherein the first segment and the second segment are not connected.

22. The base assembly of claim 20, wherein the first segment and the second segment are connected.

23. The base assembly of claim 20, wherein:

the first segment has a first edge portion, the second segment has a second edge portion, the first edge portion covers a first portion of the base guide path, the second edge portion covers a second portion of the base guide path, and the first edge portion and the second edge portion define the track plate guide path.

24. The base assembly of claim 20, wherein the track includes one or more portions that run parallel to a longitudinal direction of the base assembly and one or more portions that run divergent to the longitudinal direction of the base assembly.

25. The base assembly of claim 20, wherein the base guide path has a Y-shaped configuration.

26. The base assembly of claim 20, wherein the track plate guide path has a Y-shaped configuration.

27. The base assembly of claim 20, wherein the track has a Y-shaped configuration.

28. The base assembly of claim 20, wherein the tee comprises:

a guide structure;

an elongated post comprising:

a first telescopic segment, a second telescopic segment configured to connect to the first telescopic segment, and an insert configured to be received within an opening of the second telescopic segment, wherein the guide structure is connected to an end of the insert; and a tee topper connected to an end of the first telescopic segment.

29. The base assembly of claim 28, wherein the guide structure comprises:

a tee car;

a guide protrusion; and a threaded connection.

30. A base assembly for a batting tee, wherein:

the base assembly comprises:

a base having a base guide path formed in an upper surface of the base; and a track plate positioned within at least a portion of the base such that the track plate covers at least a portion of the upper surface of the base, wherein:

the track plate comprises a first segment and a second segment, at least a portion of the second segment surrounds at least a portion of the first segment, a position of the first segment relative to a position of the second segment defines a track plate guide path that extends between the first segment and the second segment such that the track plate guide path has a same shape as the base guide path and is positioned above the base guide path, and alignment of the track plate guide path and the base guide path form a non-linear track, such that the track is configured to slidably receive a portion of a tee; and the tee comprises:

a guide structure that comprises:

a tee car;

a guide protrusion; and a threaded connection an elongated post comprising a first telescopic segment, a second telescopic segment configured to connect to the first telescopic segment, and an insert configured to be received within an opening of the second telescopic segment, wherein the guide structure is connected to an end of the insert; and a tee topper connected to an end of the first telescopic segment.

31. The base assembly of claim 30, wherein the first segment and the second segment are not connected.

32. The base assembly of claim 30, wherein the first segment and the second segment are connected.

33. The base assembly of claim 30, wherein the track includes one or more portions that run parallel to a longitudinal direction of the base assembly and one or more portions that run divergent to the longitudinal direction of the base assembly.

34. The base assembly of claim 30, wherein the base guide path has a Y-shaped configuration.

35. The base assembly of claim 30, wherein the track plate guide path has a Y-shaped configuration.

36. The base assembly of claim 30, wherein the track has a Y-shaped configuration.

* * * * *